US007075406B2

(12) United States Patent
Ramarge

(10) Patent No.: US 7,075,406 B2
(45) Date of Patent: Jul. 11, 2006

(54) STATION CLASS SURGE ARRESTER

(75) Inventor: Michael M. Ramarge, Olean, NY (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 10/800,645

(22) Filed: Mar. 16, 2004

(65) Prior Publication Data

US 2005/0207084 A1 Sep. 22, 2005

(51) Int. Cl.
*H01C 7/10* (2006.01)

(52) U.S. Cl. ..... 338/21

(58) Field of Classification Search ..... 338/20, 338/21; 361/117, 127
See application file for complete search history.

(56) References Cited

U.S. PATENT DOCUMENTS

| | | | | |
|---|---|---|---|---|
| 3,913,127 | A | 10/1975 | Suzuki et al. | |
| 4,272,411 | A | 6/1981 | Sokoly et al. | |
| 4,282,557 | A | 8/1981 | Stetson | |
| 4,296,002 | A | 10/1981 | Sokoly et al. | |
| 4,352,140 | A | 9/1982 | Axelsson et al. | |
| 4,388,603 | A | 6/1983 | Hassler et al. | |
| 4,404,614 | A | 9/1983 | Koch et al. | |
| 4,444,351 | A | 4/1984 | Dries et al. | |
| 4,456,942 | A | 6/1984 | Bronikowski | |
| 4,491,687 | A | 1/1985 | Kaczerginski et al. | |
| 4,656,555 | A * | 4/1987 | Raudabaugh | 361/117 |
| 4,729,053 | A | 3/1988 | Maier et al. | |
| 4,780,598 | A | 10/1988 | Fahey et al. | |
| 4,825,188 | A | 4/1989 | Parraud et al. | |
| 4,833,438 | A | 5/1989 | Parraud et al. | |
| 4,851,955 | A * | 7/1989 | Doone et al. | 361/117 |
| 4,899,248 | A | 2/1990 | Raudabaugh | |
| 4,962,440 | A | 10/1990 | Johnnerfelt et al. | |
| 4,992,906 | A | 2/1991 | Doone et al. | |
| 5,003,689 | A | 4/1991 | Doone et al. | |
| 5,008,646 | A | 4/1991 | Hennings et al. | |
| 5,043,838 | A * | 8/1991 | Sakich | 361/117 |
| 5,047,891 | A * | 9/1991 | Nedriga | 361/117 |
| 5,050,032 | A * | 9/1991 | Thevenet et al. | 361/117 |
| 5,128,824 | A | 7/1992 | Yaworski et al. | |
| 5,138,517 | A | 8/1992 | Raudabaugh | |
| 5,159,748 | A | 11/1992 | Doone et al. | |
| 5,218,508 | A | 6/1993 | Doone | |
| 5,220,480 | A | 6/1993 | Kershaw, Jr. et al. | |
| 5,225,111 | A * | 7/1993 | Imai | 252/519.52 |

(Continued)

FOREIGN PATENT DOCUMENTS

| | | |
|---|---|---|
| DE | 3 334 533 | 4/1985 |

(Continued)

OTHER PUBLICATIONS

Polymer Distribtuion and Riser Pole Aresstors, GE Transimission, Distributions & Industrial Syst. Jan. 13, 2000.*

(Continued)

*Primary Examiner*—Tu Hoang
(74) *Attorney, Agent, or Firm*—Fish & Richardson P.C.

(57) ABSTRACT

A station class surge arrester includes a module assembly. The module assembly includes at least one metal oxide varistor (MOV) disk and a pre-impregnated composite that is applied around the at least one MOV disk. The pre-impregnated composite is capable of withstanding an 80 kA fault current for 12 cycles. The station class surge arrester also includes contacts on opposite ends of the module assembly with which the module assembly is connected to electrical equipment to be protected and to electrical ground.

22 Claims, 4 Drawing Sheets

U.S. PATENT DOCUMENTS

| | | | | | |
|---|---|---|---|---|---|
| 5,225,265 | A | | 7/1993 | Prandy et al. | |
| 5,237,482 | A | | 8/1993 | Osterhout et al. | |
| 5,291,366 | A | | 3/1994 | Giese et al. | |
| 5,313,184 | A | | 5/1994 | Greuter et al. | |
| 5,363,266 | A | | 11/1994 | Wiseman et al. | |
| 5,402,100 | A | * | 3/1995 | Urbanek et al. | 338/21 |
| 5,497,138 | A | | 3/1996 | Malpiece et al. | |
| 5,570,264 | A | | 10/1996 | Lundquist et al. | |
| 5,602,710 | A | | 2/1997 | Schmidt et al. | |
| 5,608,597 | A | | 3/1997 | Holmström et al. | |
| 5,652,690 | A | | 7/1997 | Mansfield et al. | |
| 5,725,952 | A | * | 3/1998 | Thornley et al. | 428/378 |
| 5,763,043 | A | * | 6/1998 | Porter et al. | 428/109 |
| 5,912,611 | A | | 6/1999 | Berggren et al. | |
| 5,923,518 | A | | 7/1999 | Hensley | |
| 5,926,356 | A | | 7/1999 | Sakich et al. | |
| 5,930,102 | A | | 7/1999 | Rook | |
| 5,936,826 | A | | 8/1999 | Schmidt | |
| 5,959,822 | A | | 9/1999 | Bock et al. | |
| 5,990,778 | A | | 11/1999 | Strümpler et al. | |
| 6,008,975 | A | * | 12/1999 | Kester et al. | 361/117 |
| 6,008,977 | A | | 12/1999 | Thatcher | |
| 6,185,813 | B1 | * | 2/2001 | Donnola | 29/613 |
| 6,279,811 | B1 | | 8/2001 | Ramarge et al. | |
| 6,396,676 | B1 | | 5/2002 | Doone et al. | |
| 2003/0043526 | A1 | | 3/2003 | Ramarge et al. | |

FOREIGN PATENT DOCUMENTS

| | | |
|---|---|---|
| EP | 0 233 022 | 8/1987 |
| EP | 0 642 141 | 3/1995 |
| EP | 1 067 565 | 1/2001 |
| JP | 03-034522 | 2/1991 |
| JP | 11-340635 | 12/1999 |
| WO | WO 97/32382 | 9/1997 |
| WO | WO 99/08353 | 2/1999 |
| WO | WO 99/18642 | 4/1999 |

OTHER PUBLICATIONS

PCT International Search Report in PCT/US2005/008675 dated Jun. 28, 2005, 5 pages.

* cited by examiner

STATION CLASS SURGE ARRESTER

TECHNICAL FIELD

This document relates to station class surge arresters.

BACKGROUND

A surge arrester is used to protect relatively expensive electrical equipment from damage during periods of over-voltage in which the voltage to which the electrical equipment is exposed is higher than a normal operating range. The surge arrester diverts current around the electrical equipment to ground during periods of over-voltage, thereby shielding the electrical equipment from the high voltages and corresponding currents. Prolonged exposure to abnormally high voltages may cause the surge arrester to fail.

Conventional station class surge arresters include one or more metal oxide varistor (MOV) disks that are held in compression within a fiberglass filament wound tube between end electrodes. Current flows through the electrodes and the MOV disks during periods of over-voltage. A relatively thick filament wound tube may be needed to provide sufficient cantilever strength for station class surge arrester applications and sufficient burst strength to withstand the current associated with periods of over-voltage. For example, the walls of some conventional filament wound tubes are one to two inches thick. Consequently, such a filament wound tube requires a large amount of material to manufacture, and occupies a relatively large amount of space.

Other conventional surge arresters use hollow core technology, in which MOV disks are placed inside the hollow core of an otherwise solid structure. Hollow core technology, which provides excellent mechanical strength, normally uses pressure relief devices to vent gases formed during device failure.

SUMMARY

In one general aspect, a station class surge arrester includes a module assembly. The module assembly includes at least one metal oxide varistor (MOV) disk and a pre-impregnated composite that is applied around the at least one MOV disk. The pre-impregnated composite is capable of withstanding an 80 kA fault current for 12 cycles. The station class surge arrester also includes contacts on opposite ends of the module assembly with which the module assembly is connected to electrical equipment to be protected and to electrical ground.

Implementations may include one or more of the following features. For example, the station class surge arrester may include a housing that surrounds the module assembly. The contacts extend through the housing to enable connection of the module assembly to the electrical equipment and to electrical ground outside of the housing.

The pre-impregnated composite may include a fabricated matrix of fiberglass bundles impregnated with epoxy resin and arranged around the at least one MOV disk. The pre-impregnated composite also may include epoxy resin that occupies any open spaces in the fabricated matrix of fiberglass bundles. In particular implementations, the pre-impregnated composite may be 50% epoxy resin by weight and may have a thickness of about 0.020 inches.

The space between the fiberglass bundles may be between 0.125 inches and 0.5 inches. For example, in particular implementations, the space between the fiberglass bundles may be 0.1875 inches. The fiberglass bundles may include E-glass 675 and/or E-glass 450.

The fabricated matrix may be based on a fabric having a hurl leno woven construction. The woven construction may have a warp count of at least 4.2 and a fill count of at least 4.4. The un-impregnated woven construction may weigh about 15 ounces per square yard or less.

The pre-impregnated composite may be applied around the at least one MOV disk multiple times. The pre-impregnated composite may be applied around the at least one MOV disk three times such that the pre-impregnated composite surrounding the at least one MOV disk has a thickness of about 0.060 inches, or two times such that the pre-impregnated composite around the at least one MOV disk has a thickness of about 0.040 inches.

The station class surge arrester may include a scrim layer applied over the pre-impregnated composite. The scrim layer may include an epoxy resin that contacts the pre-impregnated composite. The scrim layer also may include an incorporated matting that contacts the pre-impregnated composite and provides a framework for the epoxy resin of the scrim layer. The incorporated matting may be made of a tightly woven polyester. The scrim layer may have a thickness substantially between 0.008 inches and 0.012 inches.

The MOV disk may have a diameter substantially between two and three inches.

The module assembly may have a cantilever strength between 10,000 in.-lbs. and 100,000 in.-lbs. For example, the module assembly may have a cantilever strength of at least 35,000 in.-lbs.

Other features will be apparent from the description and drawings, and from the claims.

DESCRIPTION OF DRAWINGS

Like reference symbols in the various drawings indicate like elements.

DETAILED DESCRIPTION

A station class surge arrester, also known as a station arrester, is used to protect electrical equipment through which very high currents flow. The station class surge arrester includes a module assembly that includes a pre-impregnated composite structure. The pre-impregnated composite structure includes a fabricated matrix of fiberglass bundles between which epoxy resin is impregnated. The resin filled spaces within the fiberglass matrix facilitates the venting of gasses from the module assembly when the surge arrester fails. A scrim layer is applied over the fiberglass matrix and epoxy resin composite to supply additional resin assuring no air voids in the module assembly. A framework for the resin in the scrim layer is provided by a matting, which may be constructed out of a tightly woven polyester.

The thickness of the pre-impregnated composite and the scrim layer is very small relative to the diameter of the module assembly. Therefore, a station class surge arrester constructed using the described techniques can be manufactured from a relatively small amount of material. As a result, the size of the station class surge arrester may be substantially smaller than conventional station class surge arresters. In addition, a station class surge arrester constructed using the described techniques possesses the necessary cantilever strength for station arrester applications. Also, a station class surge arrester constructed using the described techniques fails in a desired, non-fragmenting, manner such that all major parts of the arrester are retained by venting through the pre-impregnated composite and the scrim layer. The use of the pre-impregnated composite and the scrim layer produces a module assembly that is impervious to moisture ingress and is a solid dielectric with suitable cantilever strength for station arrester applications and burst strength to vent in the desired manner during failure modes.

Figure 1:
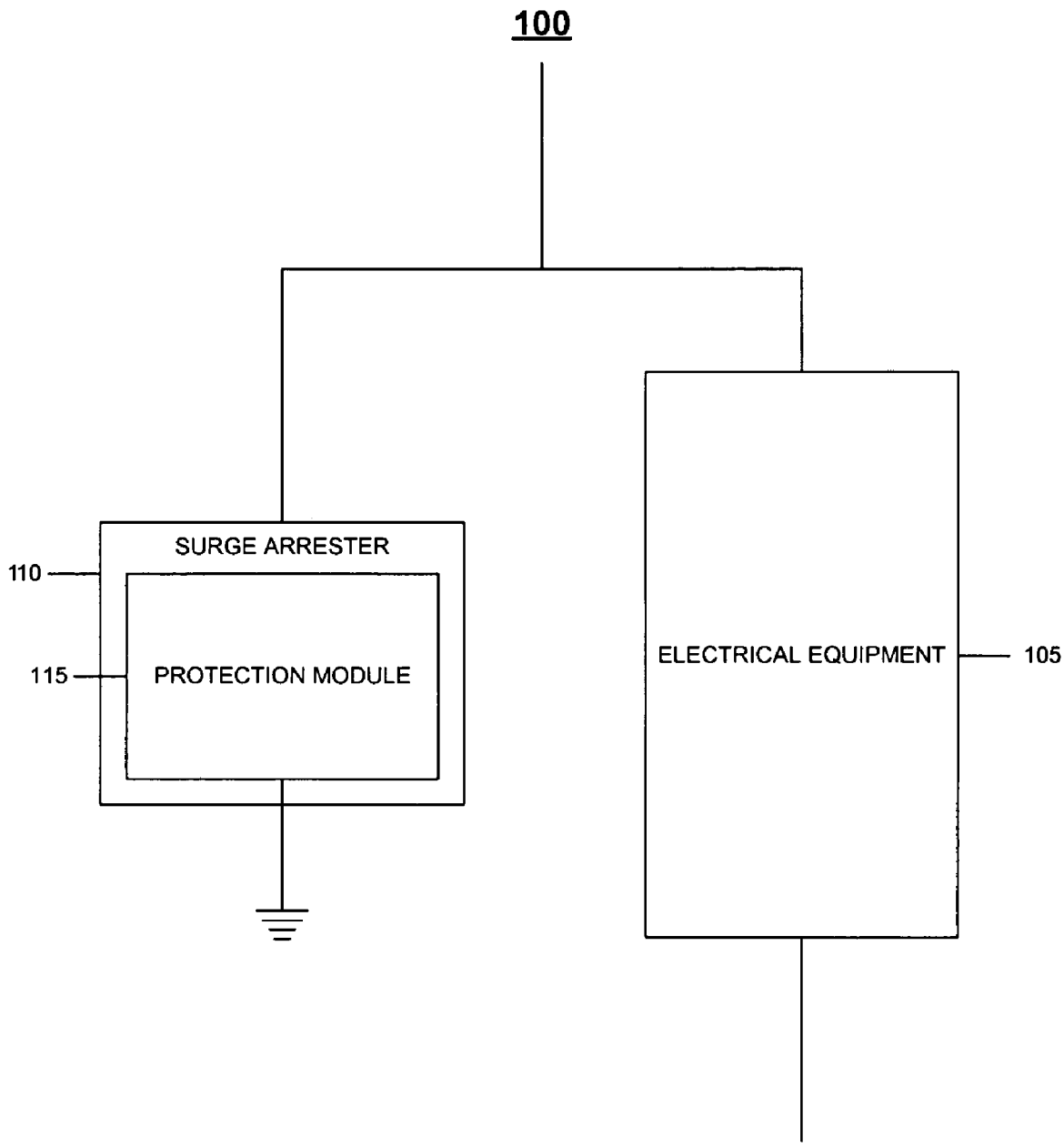
FIG. 1 is a block diagram of an electrical system in which electrical equipment is protected by a surge arrester.

Referring to FIG. 1, an electrical system 100 includes electrical equipment 105 that is protected by a surge arrester 110. In implementations where the electrical equipment can be exposed to very high energy associated with switching events on the electrical equipment 105, the surge arrester 110 is a station class surge arrester that is capable of protecting the electrical equipment 105. The surge arrester 110 shunts or diverts over-voltage-induced current surges safely around the electrical equipment 105 to ground, and thereby protects the equipment 105 and its internal circuitry from damage. The surge arrester 110 includes a module assembly 115 that directs current to or away from the electrical equipment 105 based on the voltage to which the module assembly 115 is exposed. In other words, the module assembly 115 causes current to flow through the surge arrester 110 during periods of over-voltage. The surge arrester 110 is connected in parallel with the electrical equipment 105. Furthermore, in implementations where the energy becomes excessive, a station class surge arrester is capable of withstanding 80 kA fault currents for 12 cycles.

The module assembly 115 typically includes a stack of one or more voltage-dependent, nonlinear resistive elements that are referred to as varistors. An example of a varistor is a MOV disk. A varistor is characterized by having a relatively high resistance when exposed to a normal operating voltage, and a much lower resistance when exposed to a larger voltage, such as is associated with over-voltage conditions. The module assembly 115 also may include one or more electrically conductive spacer elements coaxially aligned with the varistors.

As a result of the included varistors, the module assembly 115 operates in a low impedance mode that provides a current path to electrical ground having a relatively low impedance when exposed to an over-voltage condition. The module assembly 115 otherwise operates in a high impedance mode that provides a current path to ground having a relatively high impedance. When the surge arrester 10 is operating in the low-impedance mode, the impedance of the current path to ground is substantially lower than the impedance of the equipment 105 being protected by the surge arrester 110. As a result, current flows through the current path to ground. The impedance otherwise is substantially higher than the impedance of the protected equipment 105, such that current flows through the electrical equipment 105. Upon completion of the over-voltage condition, the surge arrester 110 returns to operation in the high impedance mode in which the impedance of the module assembly 115 is relatively high. This prevents normal current at the system frequency from following the surge current to ground along the current path through the surge arrester 110.

In some implementations, the electrical equipment 105 may be a transformer that converts a voltage on an input to the transformer to a corresponding voltage on an output of the transformer. For example, the transformer may be included in a substation that also includes the surge arrester 110.

In such applications the outside of the module assembly 115 includes a relatively thin layer of pre-impregnated composite. The pre-impregnated composite layer provides the dielectric module assembly 115 with sufficient mechanical strength to withstand fault current events typical of station class surge arresters while reducing the amount of material used in the station class surge arrester 110, the overall diameter of the module assembly 115, and the size of the surge arrester 110.

Figure 2:
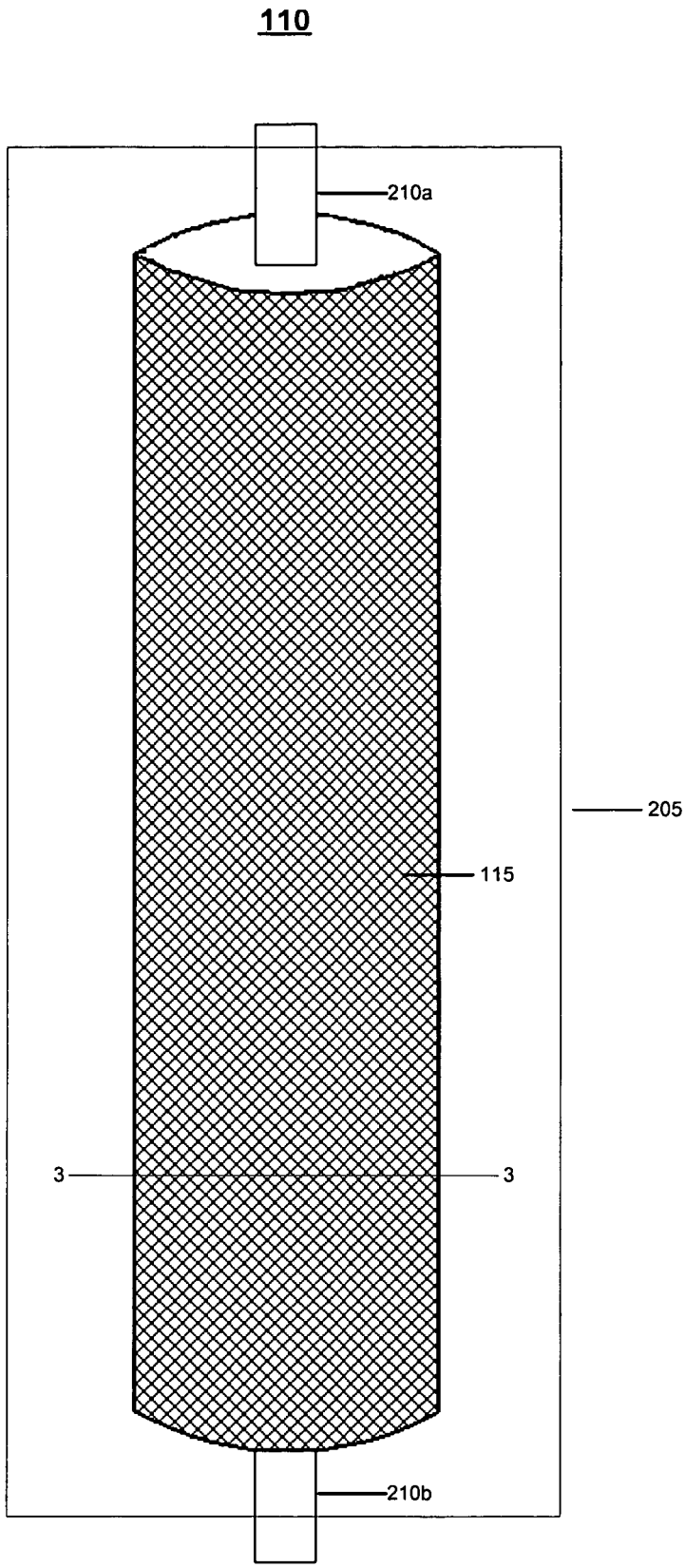
FIG. 2 is a block diagram of the surge arrester of FIG. 1.

Referring to FIG. 2, the surge arrester 110 includes a housing 205 in which the module assembly 115 is located. The housing 205 protects the surge arrester 110 from environmental conditions and is made of an electrically insulating polymeric material. An insulating or dielectric compound, such as room temperature vulcanized silicone, fills any voids between the module assembly 115 and the inner surface of the housing 205. A contact 210*a* is disposed in an upper terminal near the top of the surge arrester 110. Similarly, a contact 210*b* is disposed in a lower terminal near the bottom of the surge arrester 110. The upper terminal and the lower terminal connect to the module assembly 115 and extend out of the housing 205 to provide a series electrical path through the surge arrester 110 from the contact 210*a* to the contact 210*b*. The surge arrester 110 is connected to a line-potential conductor at the contact 210*a* and to ground at the contact 210*b*. The surge arrester 110 also is connected to electrical equipment protected by the surge arrester at the contact 210*a*. More particularly, an end of the surge arrester 110 and an end of the electrical equipment 105 that are both connected to the line-potential conductor are connected at the contact 210*a*. The housing 205 is sealed about the upper and lower ends of the module assembly 115.

The module assembly 115 includes one or more MOV disks that are contained within a pre-impregnated composite structure. The pre-impregnated composite includes a fabricated matrix of fiberglass bundles, and the space between the fiberglass bundles is filled with an epoxy resin. The pre-impregnated composite may be applied around the MOV disks multiple times. A scrim layer is applied over the pre-impregnated composite. The scrim layer includes epoxy resin and a polyester matting that provides a framework to the epoxy resin. The scrim layer provides additional resin to assure that the module assembly 115 is an air-free, solid dielectric module.

Shrink film is then applied to the module assembly 115 over the scrim layer to aid in compacting the pre-impregnated composite structure. In one implementation, the shrink film is a bi-axially oriented polypropylene film. When heated, the shrink film shrinks and applies a compressive force to the module assembly 115. The shrink film is attached substantially at one end of the module assembly 115, spiral wound around the length of the module assembly 115, and attached to the opposite end of the module assembly 115. After the shrink film has been applied to the entire module assembly 115, the module assembly 115 is heated to a first temperature range that makes the epoxy resin of the pre-impregnated composite structure and the scrim layer viscous, and causes the shrink film to shrink and compact the viscous pre-impregnated composite structure and scrim layer. The module assembly 115 then is heated to a second temperature range for curing that is greater than the first temperature range. The second temperature range is high enough that the shrink film relaxes and does not apply a compressive force to the module assembly 115 as the module assembly 115 is cured. After curing, the shrink film is removed from the module assembly 115, and the module assembly 115 is included in the surge arrester 110.

Figure 3:
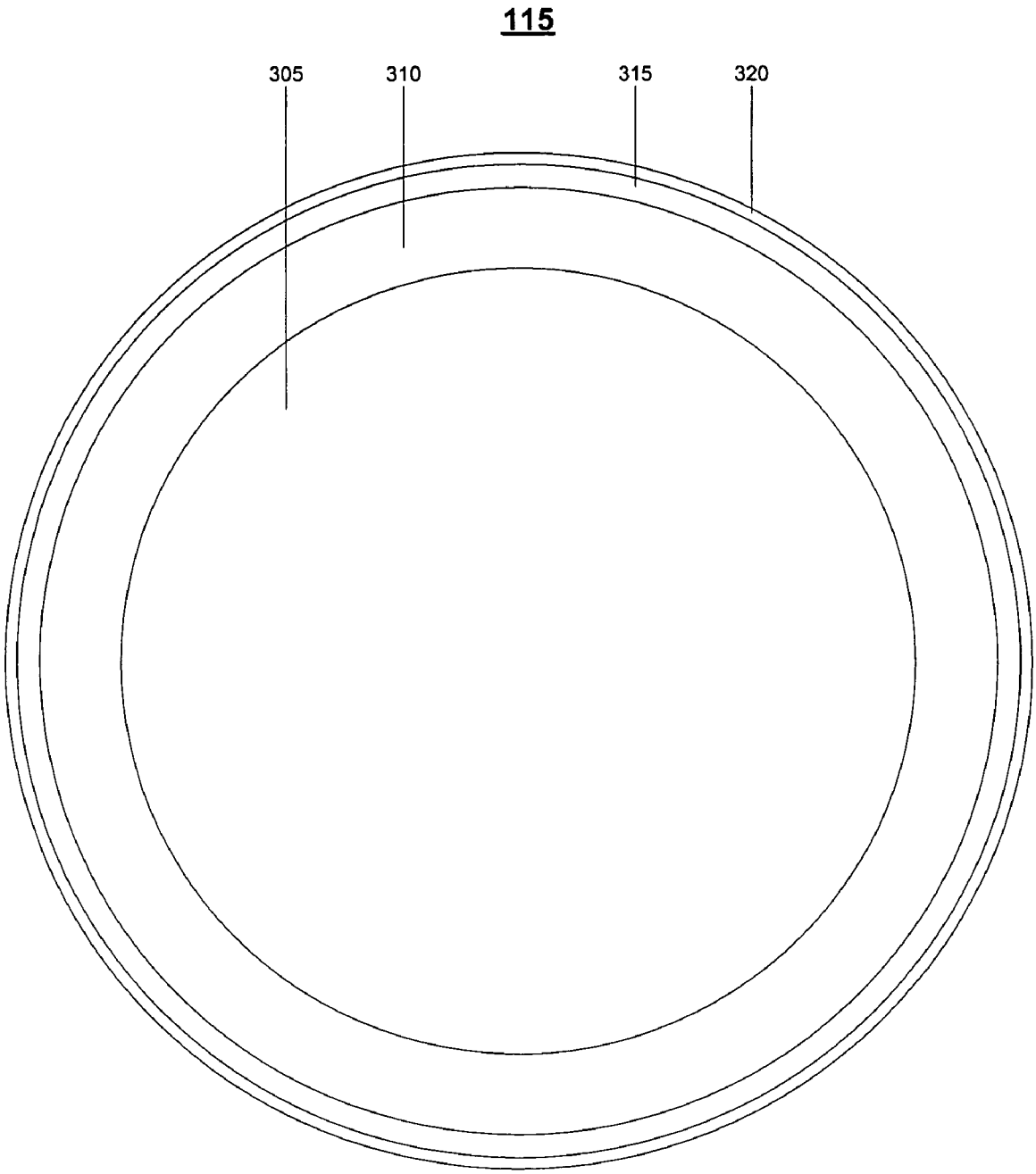
FIG. 3 is a cross section of a module assembly from the surge arrester of FIG. 1.

Referring to FIG. 3, a cross sectional view of the module assembly 115 taken along section 3—3 reveals the inner configuration of the module assembly 115. At the center of the cross sectional view of the module assembly 115 is an MOV disk 305. The module assembly 115 may include multiple stacked MOV disk or a single MOV disk. The MOV disk 305 is a voltage-dependent, nonlinear-resistive element. The MOV disk has a high impedance when exposed to voltages in a normal operating range and a low impedance when exposed to voltages above the normal operating range. When the MOV disk 305 is exposed to voltages within the normal operating range, the impedance of electrical equipment that is protected by a surge arrester that includes the module assembly 115 is substantially lower than the impedance of the MOV disk 305, so current flows through the electrical equipment. Similarly, when the MOV disk 305 is exposed to voltages above the normal operating range, the impedance of electrical equipment is substantially higher than the impedance of the MOV disk 305, and current flows through the surge arrester. Though the MOV disk 305 may have any diameter, the diameter in particular implementations is between 2 and 3 inches.

A pre-impregnated composite 310 is applied around the MOV disk 305. In one implementation, the pre-impregnated composite 310 has a thickness of 0.020 inches. In some implementations, the pre-impregnated composite 310 is applied around the MOV disk 305 multiple times. For example, the MOV disks may be covered with the pre-impregnated composite 310 two or three times to produce a total thickness of the pre-impregnated composite sheet 310 of either 0.040 inches or 0.060 inches. The pre-impregnated composite provides the module assembly 115 with a cantilever strength between 10,000 and 100,000 in.-lbs. For example, in particular implementations, the pre-impregnated composite may provide the module assembly 115 with a cantilever strength of 35,000 in.-lbs.

Figure 4:
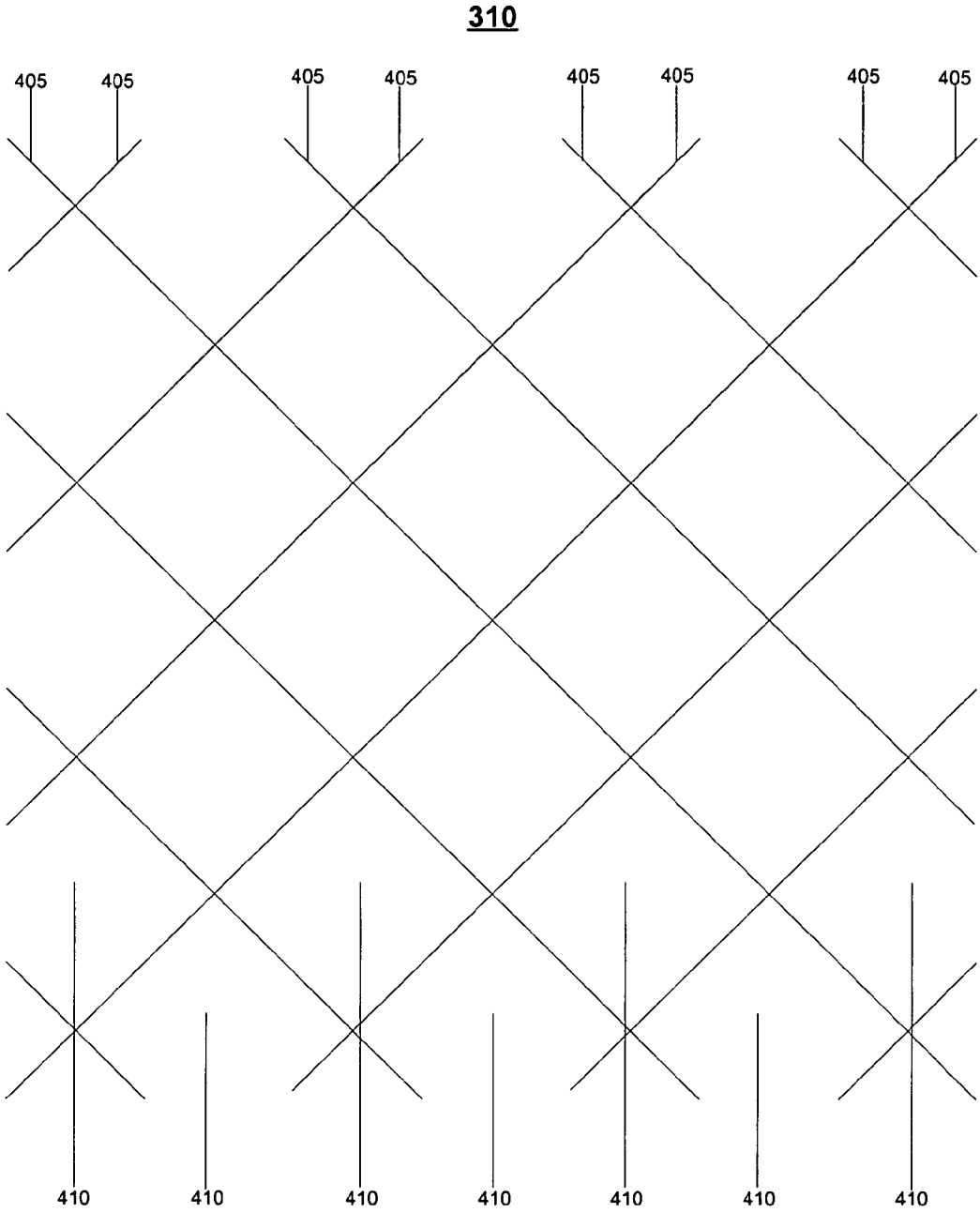
FIG. 4 is an illustration of the surface of the module assembly from the surge arrester of FIG. 1.

Referring also to FIG. 4, the pre-impregnated composite 310 includes multiple orientations of the fiberglass bundles 405. The fiberglass bundles 405 may be arranged in an orderly or random manner throughout the pre-impregnated composite 310. For example, the fiberglass bundles 405 may be arranged such that the fiberglass bundles 405 cross at right angles to one another. As a result of the arrangement of the fiberglass bundles 405, the pre-impregnated composite 310 may include spaces 410 between the fiberglass bundles 405. In some implementations, the fiberglass bundles 405 may be arranged such that a space of between 0.125 and 0.5 inches exists between the fiberglass bundles 405. For example, a space of 0.1875 inches may exist between the fiberglass bundles 405. The spaces 410 between the fiberglass bundles 405 are filled with epoxy resin. In some implementations, the pre-impregnated composite is 50% epoxy resin by weight.

In particular implementations, the pre-impregnated composite 310 may be based on a fabric having a hurl leno woven construction. The woven construction may have a warp count of at least 4.2 and a fill count of at least 4.4. The un-impregnated woven construction may weigh 15 ounces per square yard or less.

When a surge arrester fails, ionized gases are generated by the power arc within the module assembly 115. As more ionized gas volume increases within the module assembly 115, the pressure of the gas within the module assembly 115 correspondingly increases. The pressure increases until the pressure is great enough to fracture the epoxy resin that fills one or more of the spaces 410. When the epoxy resin filling one or more of the spaces 410 has been fractured, the ionized gases escape the module assembly 115 through the fractured spaces 410. As a result of venting of the ionized gases, the pressure within the module assembly 115 decreases rapidly as the power arc is transferred outside of the module assembly 115. The station class surge arrester that includes the module assembly 115 is left in a non-operable state. The venting of the station arrester 110 and of the module assembly 115 in the desired manner during failure ensures that electrical equipment being protected by the station arrester 115 is not damaged. If the gas within the module assembly 115 did not vent in the desired manner, the pressure of the gas would increase until the module assembly 115 did not have enough mechanical strength to withstand the pressure. In such a case, the module assembly 115 could fail catastrophically, potentially expelling parts that could damage electrical equipment being protected by the station arrester.

Referring again to FIG. 3, a scrim layer is applied over the pre-impregnated composite 310. In some implementations, the scrim layer has a thickness between 0.008 inches and 0.012 inches. The scrim layer includes epoxy resin 315 and a matting 320 that provides a framework to the epoxy resin. The scrim layer provides additional resin for assuring an air free solid dielectric module assembly 115. The matting may be made out of a tightly woven polyester. The matting 320 is thinner and weaker than the epoxy resin 315, and, when the epoxy resin included in the pre-impregnated composite 310 is fractured to enable venting of gasses, the matting 320 is easily fractured as well.

The thickness of the pre-impregnated composite 310 and the scrim layer relative to the thickness of the MOV disk 305 is very small. As a result, a relatively small amount of material is needed to manufacture the module assembly 115, and the size of the module assembly is reduced. Therefore, the size and weight of the surge arrester that includes the module assembly is similarly reduced, as are the manufacturing cost of the station arrester and the clearance distances associated with the station arrester.

It will be understood that various modifications may be made. For example, advantageous results still could be achieved if components in the disclosed systems were combined in a different manner and/or replaced or supplemented by other components. Accordingly, other implementations are within the scope of the following claims.

What is claimed is:

1. A station class surge arrester comprising:

a module assembly including at least one metal oxide varistor (MOV) disk;

a pre-impregnated composite including a matrix of fiberglass bundles and epoxy resin that occupies open spaces in the matrix of fiberglass bundles, the pre-impregnated composite continuously covering a circumferential surface of the at least one MOV disk, and being capable of withstanding an 80 kA fault current for 12 time cycles; and contacts on opposite ends of the module assembly with which the module assembly is connected to electrical equipment to be protected and to electrical ground.

2. The station class surge arrester of claim 1 further comprising a housing, wherein:

the housing surrounds the module assembly; and the contacts extend through the housing to enable connection of the module assembly to the electrical equipment and to electrical ground outside of the housing.

3. The station class surge arrester of claim 1 wherein the pre-impregnated composite is capable of withstanding an 80 kA fault current for 12 time cycles of an electrical system to which the station class surge arrester is connected.

4. The station class surge arrester of claim 1 wherein the space between the fiberglass bundles is between 0.125 inches and 0.5 inches.

5. The station class surge arrester of claim 4 wherein the space between the fiberglass bundles is 0.1875 inches.

6. The station class surge arrester of claim 1 wherein the matrix is based on a fabric having a hurl leno woven construction.

7. The station class surge arrester of claim 6 wherein the woven construction has a warp count of at least 4.2.

8. The station class surge arrester of claim 6 wherein the woven construction has a fill count of at least 4.4.

9. The station class surge arrester of claim 6 wherein the weight of the un-impregnated woven construction is 15 ounces per square yard or less.

10. The station class surge arrester of claim 1 wherein the module assembly has a cantilever strength of about 35,000 in.-lbs.

11. The station class surge arrester of claim 1 wherein the pre-impregnated composite extends around the circumferential surface of the at least one MOV disk as a single continuous sheet.

12. The station class surge arrester of claim 1 wherein the pre-impregnated composite is at least 50% epoxy resin by weight.

13. The station class surge arrester of claim 1 wherein the pre-impregnated composite has a thickness of about 0.020 inches.

14. The station class surge arrester of claim 1 wherein the pre-impregnated composite covers the at least one MOV disk multiple times.

15. The station class surge arrester of claim 14 wherein the pre-impregnated composite covers the at least one MOV disk three times such that the pre-impregnated composite covering the at least one MOV disk has a thickness of about 0.060 inches.

16. The station class surge arrester of claim 14 wherein the pre-impregnated composite covers the at least one MOV disk two times such that the pre-impregnated composite covering the at least one MOV disk has a thickness of about 0.040 inches.

17. The station class surge arrester of claim 1 further comprising a scrim layer applied over the pre-impregnated composite.

18. The station class surge arrester of claim 17 wherein the scrim layer comprises:

an epoxy resin that contacts the pre-impregnated composite;

an incorporated matting that contacts the pre-impregnated composite and provides a framework for the epoxy resin of the scrim layer.

19. The station class surge arrester of claim 18 wherein the incorporated matting is made of a tightly woven polyester.

20. The station class surge arrester of claim 17 wherein the scrim layer has a thickness substantially between 0.008 inches and 0.012 inches.

21. The station class surge-arrester of claim 1 wherein the at least one MOV disk has a diameter substantially between two and three inches.

22. The station class surge arrester of claim 1 wherein the module assembly has a cantilever strength between 10,000 in.-lbs. and 100,000 in.-lbs.

* * * * *